US007556691B2

(12) United States Patent
Rogers et al.

(10) Patent No.: US 7,556,691 B2
(45) Date of Patent: Jul. 7, 2009

(54) SPIN ART APPARATUS

(75) Inventors: Jeffrey Rogers, Milford, NJ (US); Paul Snyder, Allentown, PA (US)

(73) Assignee: Crayola LLC, Easton, PA (US)

( * ) Notice: Subject to any disclaimer, the term of this patent is extended or adjusted under 35 U.S.C. 154(b) by 402 days.

(21) Appl. No.: 11/354,420

(22) Filed: Feb. 15, 2006

(65) Prior Publication Data

US 2006/0207499 A1 Sep. 21, 2006

Related U.S. Application Data

(60) Provisional application No. 60/653,044, filed on Feb. 15, 2005.

(51) Int. Cl.
*B05B 3/00* (2006.01)
*A63H 13/15* (2006.01)

(52) U.S. Cl. ..... 118/323; 446/146; 239/225.1

(58) Field of Classification Search ..... 118/300, 118/321, 323, 52, 612, 56; 239/225.1, 246, 239/211, 264, 289; 434/84, 101; 446/146, 446/483, 46; 427/427.3
See application file for complete search history.

(56) References Cited

U.S. PATENT DOCUMENTS 1,987,814 A * 1/1935 Balaam ..... 239/242
2,673,636 A * 3/1954 Vermette ..... 193/42
4,421,276 A * 12/1983 Rodgers ..... 239/273

* cited by examiner

*Primary Examiner*—Yewebdar T Tadesse
(74) *Attorney, Agent, or Firm*—Shook, Hardy & Bacon, L.L.P.

(57) ABSTRACT

A device allowing a user to create creating artistic designs on an underlying surface is provided. The device includes a base comprising a plurality of legs. The base supports a central hub at an elevated position. A paint tube is rotatably received in the hub and is spun by a motor. The paint tube has an opening therein for receiving paint and a transverse section comprising multiple open ends for expelling paint during use. The user pours paint into a funnel, which directs the paint into the paint tube. Gravity pulls the paint into the transverse section. When the motor is activated, the motor rotates the paint tube. Centrifugal forces expel the paint from the paint tube, creating a swirl design on the underlying surface.

12 Claims, 2 Drawing Sheets

SPIN ART APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to the field of painting devices, and, in particular, to a new and useful device for dispensing paint radially across an underlying surface.

2. Description of the Prior Art

Children have enjoyed playing with paint for years. Creating artistic designs provides a pleasurable way for children to express themselves while developing essential creative, intellectual, and motor skills. Numerous toys have been created in an attempt to present children with entertaining devices that foster their artistic capabilities. These artistic devices vary from simple painting sets that include brushes and assorted paints to more complex paint sets that include assisting devices such as stencils and ink stamps.

One particular type of painting is "spin art," which deposits radial paint patterns on a surface. To produce spin art, some conventional devices spin a surface onto which paint is dropped. The ease with which spin patterns are obtained and the unique character of each design make spin art devices entertaining to users. In addition, users have the ability to create spin art using different colors as well as modifying the speed of the rotation to affect the paint pattern.

Many conventional spin-art devices merely rotate the surface upon which paint is applied. While complicated designs can be created, such devices limit users to rather small surfaces. For these devices to create larger pieces of spin art, larger surfaces would have to be rotated. Larger surfaces require more electrical power, heavier motors, and stronger drive gears.

BRIEF SUMMARY OF THE INVENTION

The present invention provides a device that allows a user to create colorful, swirling designs upon an underlying surface on which the device rests during use. The device includes a base having a plurality of legs connected to a central hub. Extending downwardly from the hub and between the plurality of legs is a paint tube which is rotatably coupled with the central hub and selectively driven at varying speeds by a motor. The paint tube comprises a transverse section that is fitted with multiple open ends. A funnel is positioned on an upper surface of the hub and is coupled with the paint tube.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Various embodiments will be better understood from the detailed description provided below and from the accompanying drawings. The detailed description and drawings, however, should not be read to limit the claims. Rather, these specifics are provided for explanatory purposes.

Figure 1:
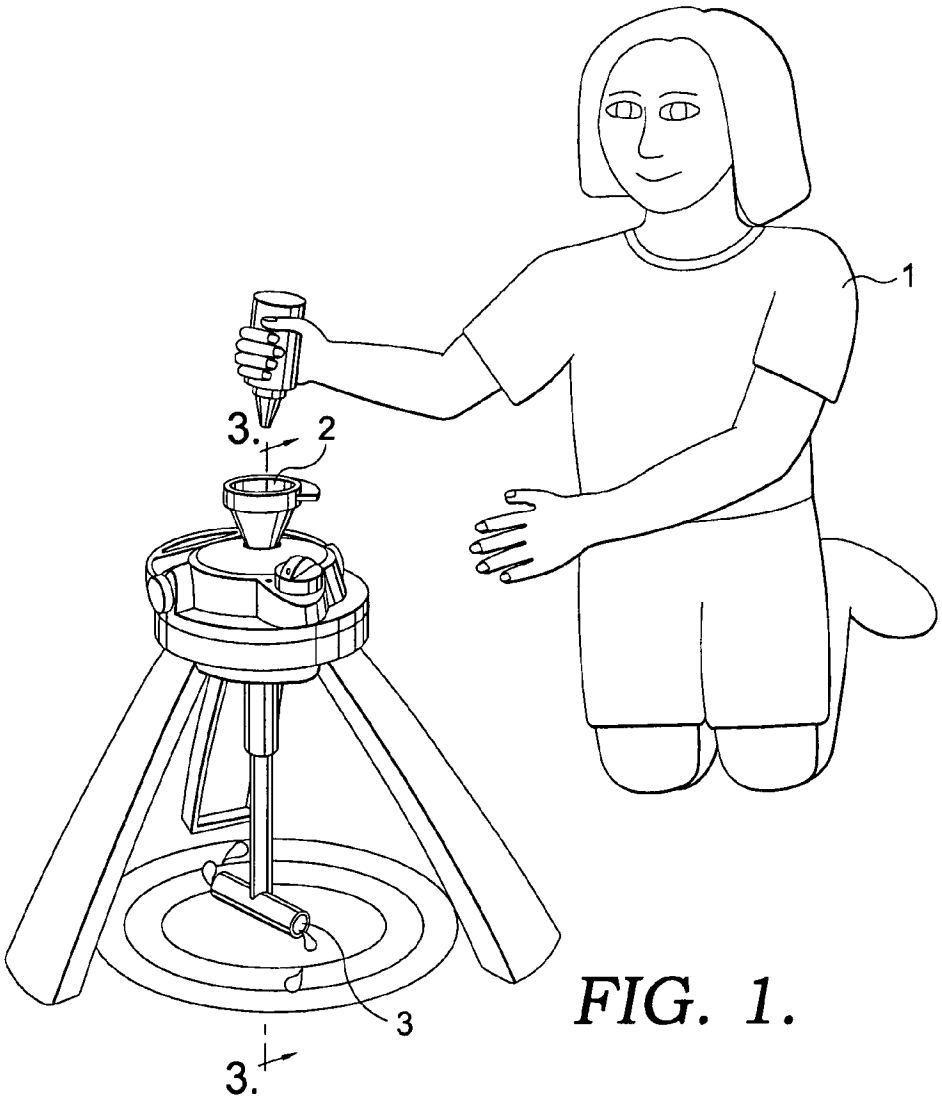
FIG. 1 is a perspective view of a device of the present invention in the expanded use position.

The invention may be described in the general context as a device used to create spin-art designs on an underlying surface. Referring now to the drawings in more detail, FIG. 1 illustrates a perspective view of the device in an expanded use position. A user inputs paint into the device at 2. As illustrated at 3, the paint is radially cast out of the device onto a surface. The radially dispersed paint creates an artistic pattern on an underlying surface. Embodiments of the present invention are not limited, however, to dispersing paint. Rather, the device may disperse any flowable artistic material capable of traveling into and through the device. For example, the device can create spin-art designs using chalk, resin, powder, ink, etc. In addition, the device, in embodiments, is made from a washable material, such as plastic.

Figure 2:
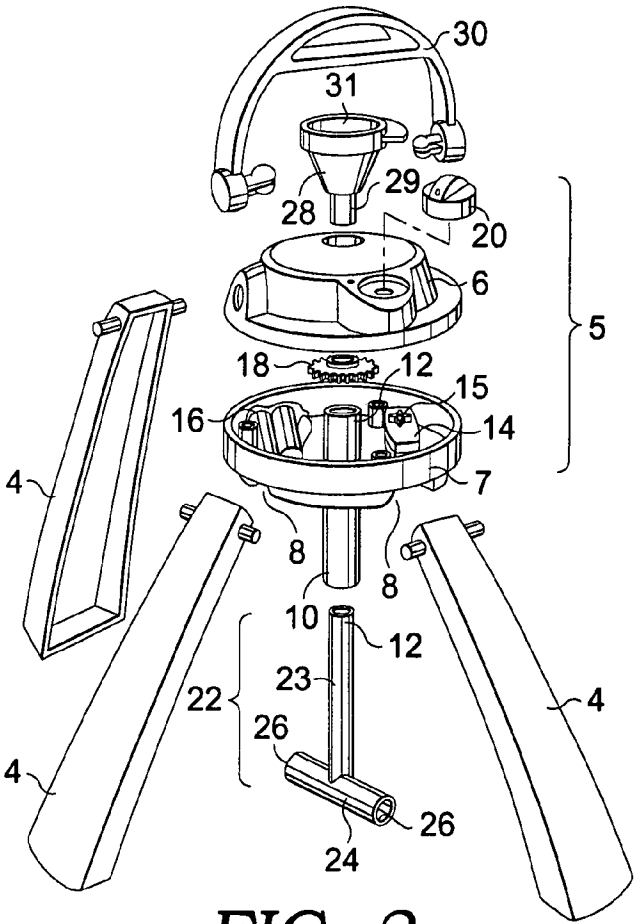
FIG. 2 is an exploded view of the device.
Figure 4:
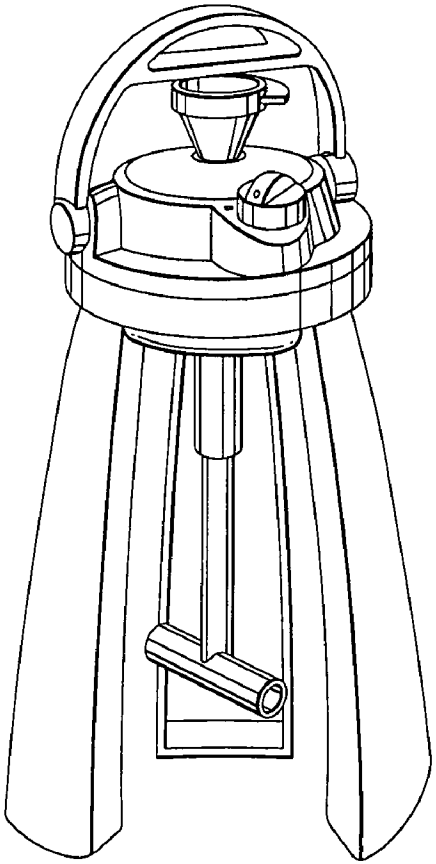
FIG. 4 is a perspective view of the device of the present invention in a collapsed state.

FIG. 2 is an exploded view of the spin art apparatus. The apparatus is supported by a base, which preferably comprises three legs 4. The legs 4 are pivotally coupled, in an embodiment, with a central hub 5 at connections 8 so as to be movable from a collapsed position in FIG. 4 to the expanded use position illustrated in FIG. 1. While the figures contained herein illustrate a three-legged base, embodiments are not limited to any specific number of legs.

As further illustrated in FIG. 2, central hub 5 comprises a top housing 6 and a bottom housing 7. The top and bottom housings 6, 7 are plastic members that support various inner components. A tube holder 10 extends through the hub 5 and out of the bottom housing 7. The tube holder 10 is an elongate cylinder for receiving paint tube 22. This arrangement allows paint to be dispensed into a funnel 28, through the hub 5, and into paint tube 22.

The hub 5 also houses a motor 14 that is electrically powered by batteries 16 and operationally rotates gear 15. In an embodiment, gear 15 is a rotational gear that is coupled with the drive gear 18. Drive gear 18 is a rotational gear that is rotatably coupled with the paint tube 22.

The motor 14, in an embodiment, is activated by the user 1 via a switch that has a user-engageable knob 20. The switch is preferably a variable-resistance switch that permits the user to selectively vary the speed at which the motor 14 rotates small gear 15. The user may vary the speed at which the paint tube 22 is rotated during use by adjusting the variable-resistance switch.

The top housing 6 supports a handle 30 that permits a user 1 to transport the device. The handle 30 is removably received by the top housing 6. A funnel 28 is removably received by the paint tube 22. The lower-most end 29 of the funnel 28 is received in an upper end 12 of the paint tube 22. This allows paint poured into the upper-most end 31 of the funnel 28 to flow through the funnel 28 and into the paint tube 22.

Figure 3:
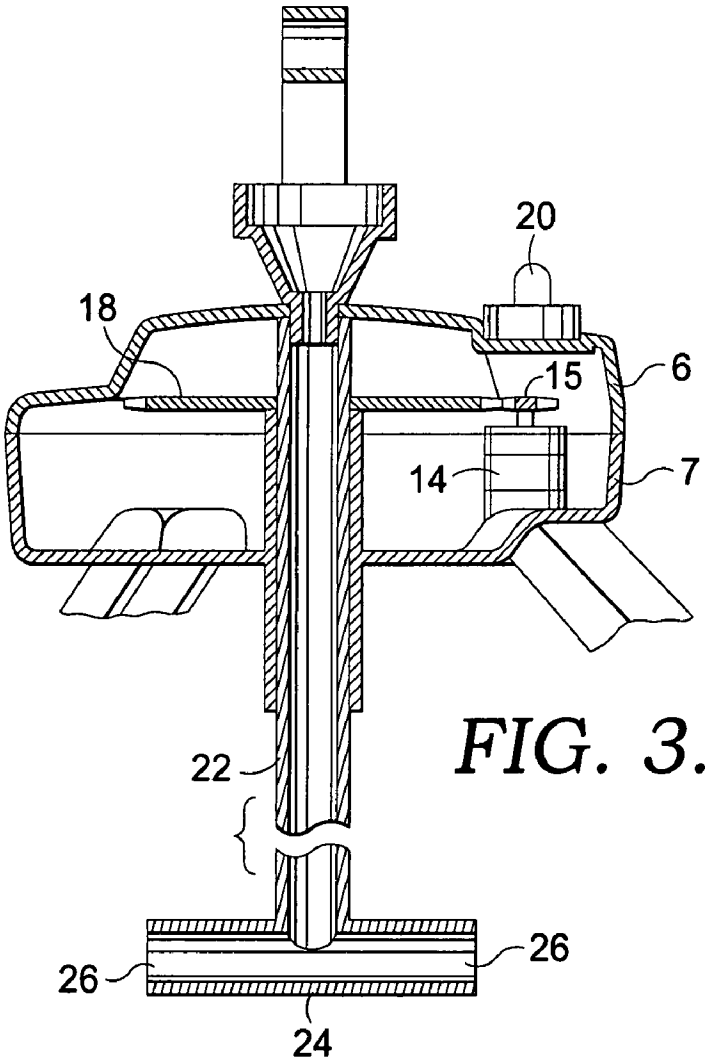
FIG. 3 is a cross-sectional view of a housing and a paint tube of the present invention.

FIG. 3 is a cross-sectional view of the hub 5 and the paint tube 22. The paint tube 22 is a hollow tube for receiving and dispersing paint and comprises an elongate section 23 and a transverse section 24. The elongate section 23 comprises the upper-end 12 that receives the funnel 28. The opposite end of the elongate section 23 internally feeds into the transverse section 24. The transverse section 24 comprises one or more open end 26 for dispersing paint. FIG. 3 illustrates an embodiment in which the transverse section 24 contains two open ends 26 that are diametrically opposed. Embodiments are not be limited, however, to any relative placement or number of open ends 26 within the transverse section 24.

In operation, the user activates the motor 14 with the knob 20. In an embodiment, the motor 14 rotates the small gear 15 which, in turn, rotates the drive gear 18, causing the paint tube 22 to rotate within hub 5. The user 1 pours paint into the funnel 28. Gravity pulls the paint downwardly through the funnel and into the paint tube 22 toward the transverse section 24. As the paint tube 22 spins, centrifugal forces cast the paint out of the open ends 26 in the transverse section 24. As a result, the dispensed paint is thrown out of the paint tube in a radial direction thereby creating a spiral design on the underlying surface as illustrated in FIG. 1.

It is to be understood that the device may be placed on a variety of underlying surfaces. For example, the spin art apparatus may be placed on paper, a driveway, a shirt or other material.

From the foregoing, it will be understood that certain features and subcombinations are of utility and may be employed without reference to other features and subcombinations. This is contemplated by and is within the scope of the invention.

Because many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A device for creating art work, the device comprising:

a base including a plurality of collapsible legs;

a housing coupled with the base;

a paint tube extending through the housing, the paint tube having a generally vertical portion with having an opening and a passage therethrough and a generally horizontal transverse portion having at least two dispensing openings, whereby paint is received in the opening of the vertical portion of the paint tube and is radially dispensed from the two openings of the horizontal transverse portion during use of the device; and means for rotating the paint tube.

2. The device of claim 1, wherein the means for rotating the paint tube includes a motor received within the housing and a gear coupled with both the motor and the paint tube.

3. The device of claim 2, wherein the motor is activated by a switch.

4. The device of claim 3, wherein the switch is a variable resistance switch to selectively vary the speed at which the motor rotates the paint tube.

5. The device of claim 1, further comprising:

a funnel to guide paint into the paint tube, wherein the funnel is removably received by the paint tube.

6. The device of claim 1, wherein the housing includes an elongated cylindrical member to receive the paint tube.

7. The device of claim 1, wherein the housing includes an elongated cylindrical member to receive the paint tube.

8. A device for creating art work, the device comprising:

a base including a plurality of collapsible legs;

a housing coupled with the base;

a paint tube extending through the housing, the paint tube having an opening therein for receiving paint and another opening for dispensing paint;

a funnel to guide paint into the paint tube, the funnel being removably received in the paint tube; and means for rotating the paint tube.

9. The device of claim 8, wherein the means for rotating the paint tube includes a motor received within the housing and a gear coupled with both the motor and the paint tube.

10. The device of claim 9, wherein the motor is activated by a switch.

11. The device of claim 10, wherein the switch is a variable resistance switch to selectively vary the speed at which the motor rotates the paint tube.

12. The device of claim 8, wherein the funnel to guide paint into the paint tube is removably received by the paint tube.

* * * * *